US005238063A

United States Patent [19]

Hebert

[11] Patent Number: 5,238,063

[45] Date of Patent: Aug. 24, 1993

[54] PRESSURE BALANCED CHARGE CONTAINER FOR WELLHEAD SEVERING SYSTEM

[75] Inventor: Joseph V. Hebert, Tomball, Tex.

[73] Assignee: MASX Energy Services Group, Inc., Houston, Tex.

[21] Appl. No.: 925,718

[22] Filed: Aug. 4, 1992

[51] Int. Cl.[5] ..... E21B 29/00

[52] U.S. Cl. ..... 166/298; 166/55

[58] Field of Search ..... 166/340, 297-299, 166/55, 55.1

[56] References Cited

U.S. PATENT DOCUMENTS 3,066,736 12/1962 Venghiattis ..... 166/298 X
3,170,517 2/1965 Graham et al. ..... 166/298 X
3,420,173 1/1969 Slawinski et al. .
3,517,616 6/1970 Martin .
3,614,988 10/1971 Moore .
4,119,148 10/1978 Deardorf ..... 166/298 X
4,470,352 9/1984 Leperre .
4,537,255 8/1985 Regalbuto et al. .
4,909,320 3/1990 Hebert .

*Primary Examiner*—Thuy M. Bui
*Attorney, Agent, or Firm*—Edgar A. Zarins; Malcolm L. Sutherland

[57] ABSTRACT

A wellhead severing system for detonating a liquid explosive charge and subsequent removal of the wellhead from the sea floor. The explosive severing system includes a charge container holding a liquid explosive and a contractable bladder in fluid communication with the charge container to compensate for pressure and temperature variations as the system is lowered to the wellhead in the sea floor. Liquid explosive from the bladder flows into the charge container maintaining a constant volume of uncontaminated explosive around the detonators. The severing system is lowered into the wellhead on a running string and detonated through high voltage wires extending to a connector or the surface.

13 Claims, 1 Drawing Sheet

PRESSURE BALANCED CHARGE CONTAINER FOR WELLHEAD SEVERING SYSTEM

BACKGROUND OF THE INVENTION

1. Field of the Invention

This invention relates to a wellhead severing system for removing wellheads from the sea floor and, in particular, to an explosive severing system which compensates for variations in pressure and temperature to maintain a constant volume of liquid explosive in the charge container.

2. Description of the Prior Art

With the increased exploration for petroleum products beneath ocean floors, nationalities have enacted strict requirements to govern such operations. One such requirement is the removal of wellheads and a specified depth of casing upon abandonment of a well. Various removal systems have been developed including mechanical severing systems which cut the casing to facilitate removal of the wellhead and explosive severing systems which rupture a section of casing below the ocean floor to allow retrieval of the wellhead.

The state of the art in marine wellhead removal involves using a liquid explosive, usually sensitized nitromethane, poured into a cylindrical charge container which is lowered into the marine wellhead and casing on the sea floor. The liquid explosive is then detonated to sever the casing allowing the wellhead and other attached structure to be pulled from the sea floor. However, it has been learned that when liquid nitromethane is lowered through the several thousand feet of ocean, the combined effects of external pressure as a result of water depth and decreased ambient temperature causes the liquid charge to contract or decrease in volume. This contraction can decrease the strength of the explosive blast and possibly result in a failure to sever the casing. Historically, the liquid contraction was avoided by leaving slight openings in the charge containers allowing sea water to fill the void created by the contracting liquid charge. In the case of nitromethane, which is heavier than water, the liquid explosive remained in the container as a result of gravity. Nevertheless, prolonged exposure of the liquid charge to sea water adversely affects the strength of the explosive or can result in a complete dilution of the charge.

SUMMARY OF THE PRESENT INVENTION

The present invention overcomes the disadvantages of the prior known wellhead severing systems by compensating for the contraction of the liquid explosive to ensure a full strength blast.

The explosive wellhead severing system includes a metal charge container which houses the liquid explosive and a detonator assembly. The charge container is sealed and separated at its upper end through which pass the detonator wires and a hose which communicate with the charge container and a soft walled container or bladder in an upper housing of the system. The bladder contains a compensating volume of liquid explosive designed to feed the charge container as the system is lowered into the wellhead. Sand around the bladder prevents high order detonation of the contents of the bladder although the size of the bladder and the volume of liquid explosive in the bladder are calculated to ensure complete transfer to the charge container as a result of contraction as depth pressure increases and temperature decreases. Accordingly, a full strength charge is maintained in the charge container ensuring severing of the casing and allowing removal of the wellhead from the sea floor.

Other objects, features and advantages of the invention will be apparent from the following detailed description taken in connection with the accompanying drawings.

BRIEF DESCRIPTION OF THE DRAWINGS

The present invention will be more fully understood by reference to the following detailed description of a preferred embodiment of the present invention when read in conjunction with the accompanying drawing in which like reference characters refer to like parts throughout the views and in which.

DETAILED DESCRIPTION OF A PREFERRED EMBODIMENT OF THE PRESENT INVENTION

Figure 1:
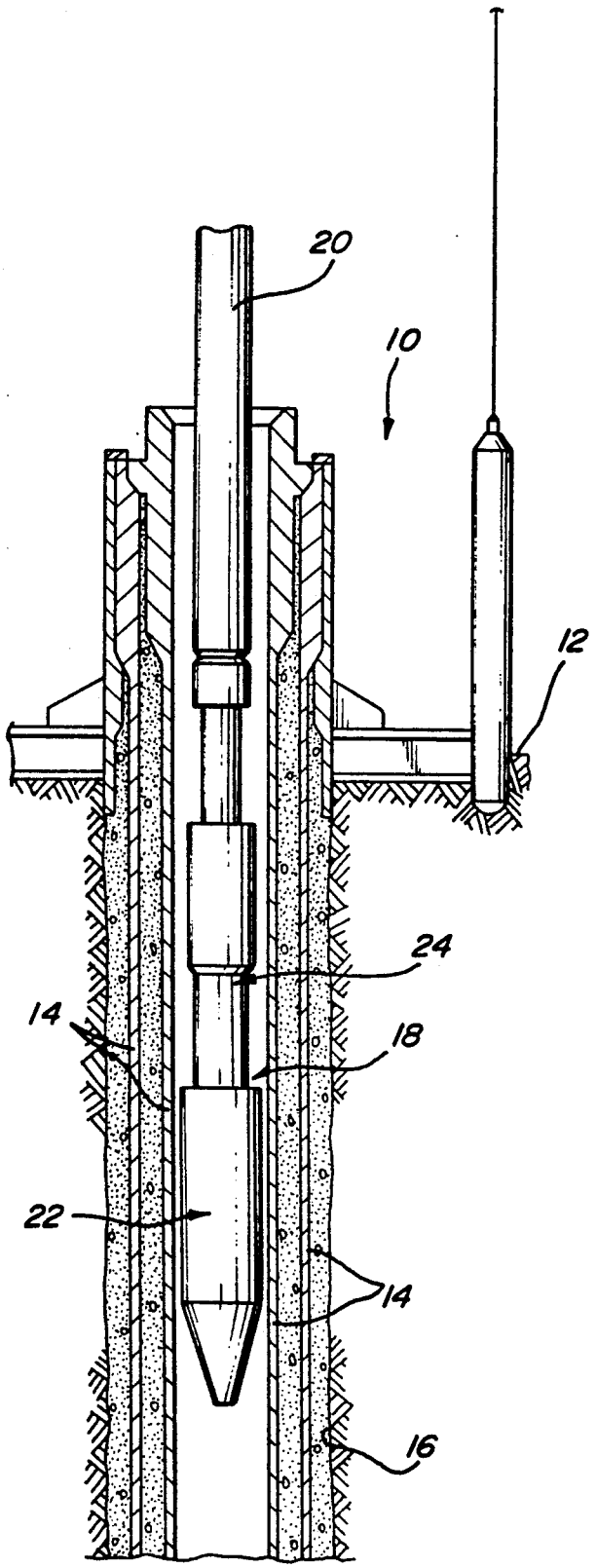
FIG. 1 is a sectional view of a submarine well with the wellhead severing system of the present invention being run into the wellhead.

Referring first to FIG. 1, there is shown a marine wellhead 10 on a floor 12 of an ocean and including sections of casing 14 extending into a wellbore 16. The casing sections 14 are typically cemented in place. The wellhead severing system 18 embodying the present invention is shown run into the casing 14 using a running string 20 or similar means. The severing system 18 is of the explosive type utilized to rupture a section of the casing 14 and cement to facilitate removal of the wellhead 10 from the sea floor 12. The present invention ensures a constant volume of liquid explosive for a controlled blast capable of severing the wellhead 10.

Figure 2:
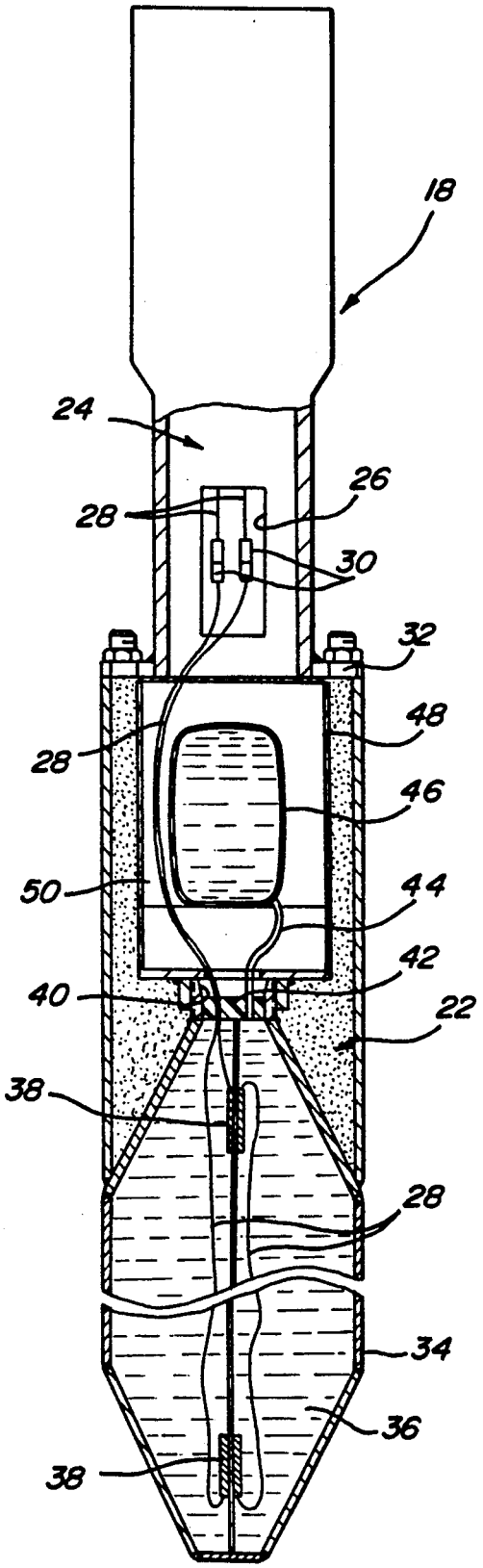
FIG. 2 is a partial cross-sectional perspective of the wellhead severing system.

Referring now to FIGS. 1 and 2, the severing system 18 of the present invention generally comprises a charge container 22 and a connector sub 24 for connecting the severing system 18 to the running string 20. The connector 24 preferably is a tubular string with a window 26 through which detonation wires 28 may pass to the charge container 22. Connectors 30 within the window 26 are utilized to connect the detonation wires 28 of the charge to detonation wires 28 which pass down the exterior of the running string 20 and sub 24 from the surface to control detonation. The window 26 allows the wires 28 to pass from the exterior of the tool to the interior. The connector sub 24 is mounted to the charge container 22 after filling using the flange connection 32.

The charge container 22 includes an explosive housing 34 which contains the liquid explosive 36, preferably sensitized nitromethane, and detonators 38 for igniting the liquid explosive 36. The detonators 38 are electrically connected to the surface through detonation wires 28 for controlled detonation of the liquid explosive 36. The housing 34 includes an upper throat 40 used to fill the housing 34 with liquid explosive 36. Once filled, the throat 40 is sealed with an elastomer stopper 42. The stopper 42 includes means for passing the detonation wires 28 through the throat 40 and a hose or tube 44 which provides fluid communication between the charge housing 34 and a collapsible bladder 46 mounted in an upper portion of the charge container 22. Preferably, the bladder 46 is mounted within a chamber 48 formed in the upper portion of the container 22 and open at its top for access to the bladder 46. The chamber 48 is removably mounted to the housing 34 to facilitate access to the throat 40 of the charge housing 34. In a preferred embodiment, the chamber 48 is surrounded by a ballast material 50 such as sand to prevent high order detonation of the contents of the bladder 46 thereby concentrating the blast from the housing 34.

Under the principles of the present invention, the bladder 46 is filled with a predetermined volume of liquid explosive such that the bladder 46 is depleted as the severing system 18 reaches its position. Both the pressure of the water depth and the decrease in temperature will result in a contraction of the volume of the liquid explosive. As this contraction occurs, the bladder 46 will collapse feeding liquid explosive to the main housing 34.

The modular construction of the present invention facilitates filling the various chambers and subsequent assembly. The charge container 34 is filled with the liquid explosive 36. The stopper 42 and detonators 38 are then installed in the housing 34, with the hose 44 and wires 28 extending into the ballast chamber. The chamber 48 is mounted onto the housing 34 and surrounded with sand 50 for ballast. The bladder 46 mounted within the chamber 48 is filled with a predetermined quantity of liquid explosive and the air removed. With the charge container 22 filled, the connector 18 is mounted thereto and the detonation wires 28 connected using connectors 30.

With the severing system 18 assembled, it can be lowered into the wellhead 10 on the sea floor 12. As the system 18 moves through the depths and temperature changes of the sea, the liquid explosive in the bladder 46 will be "squeezed" into the main charge housing 34. When the severing system 18 reaches the desired level within the wellhead 10, the liquid explosive can be detonated from the surface rupturing the casing 14 and cement and permitting withdrawal of the wellhead 10 from the sea floor 12.

The foregoing detailed description has been given for clearness of understanding only and no unnecessary limitations should be understood therefrom as some modifications will be obvious to those skilled in the art without departing from the scope and spirit of the appended claims.

What is claimed is:

1. A marine wellhead severing system for explosively rupturing a section of downhole casing to facilitate removal of the wellhead from the sea floor, said severing system lowerable into the wellhead from a surface vessel, said severing system comprising:

a primary charge container housing a liquid explosive and means for detonating said liquid explosive; and a collapsible charge container in fluid communication with said primary charge container, said collapsible charge container supplied with a predetermined volume of liquid explosive such that as said severing system is lowered to the wellhead, pressure and temperature variations affecting the volume of liquid explosive in said primary charge container will be compensated for by said collapsible charge container to ensure a constant volume of liquid explosive in said primary charge container.

2. The severing system as defined in claim 1 wherein said primary charge container and said collapsible charge container are in a ballast housing connected to means for running said severing system into the wellhead.

3. The severing system as defined in claim 2 wherein said means for running said severing system into the wellhead is a drill pipe.

4. The severing system as defined in claim 2 wherein said detonating means includes at least one detonator in said primary charge container and detonating wires electrically connecting said at least one detonator to the surface vessel.

5. The severing system as defined in claim 2 wherein said collapsible charge container is fluidly connected to said primary charge container by a flexible hose whereby liquid explosive may flow between said primary and said collapsible charge container.

6. The severing system as defined in claim 5 wherein said collapsible charge container is surrounded by ballast such that the severing explosion is directed from said primary charge container.

7. The severing system as defined in claim 6 wherein said severing system has a modular construction to facilitate filling of said primary charge container, said collapsible charge container and said ballast housing and subsequent assembly to a connector sub of said severing system.

8. A marine wellhead severing system for explosively rupturing a section of downhole casing to facilitate removal of the wellhead from the sea floor, said severing system lowerable into the wellhead from a surface vessel, said severing system comprising:

a ballast housing connected to a running sub, said running sub detachably connectable to means for running said severing system into the wellhead;

a primary charge container housing a liquid explosive and means for detonating said liquid explosive, said primary charge container forming a portion of said ballast housing; and a collapsible charge container mounted in said ballast housing in fluid communication with said primary charge container, said collapsible charge container supplied with a predetermined volume of liquid explosives such that as said severing system is lowered to the wellhead, pressure and temperature variations affecting the volume of liquid explosive in said primary charge container will be compensated for by said collapsible charge container to ensure a constant volume of liquid explosive in said primary charge container for a controlled blast to rupture the downhole casing.

9. The severing system as defined in claim 8 wherein said detonating means includes at least one detonator mounted within said primary charge container and detonating wires electrically connecting said at least one detonator to the surface vessel, said detonating wires extending through said ballast housing and said running sub.

10. The severing system as defined in claim 8 wherein said collapsible charge container is fluidly connected to said primary charge container by a flexible hose whereby liquid explosive may flow between said primary and said collapsible charge container as pressure and temperature affects the volume of liquid explosive in said primary charge container.

11. The severing system as defined in claim 10 wherein said collapsible charge container is a flexible bladder.

12. The severing system as defined in claim 8 wherein said liquid explosive is nitromethane.

13. In a marine wellhead severing system for explosively rupturing a section of downhole casing to facilitate removal of the wellhead from the sea floor, said severing system lowerable into the wellhead from a surface vessel and including a primary charge container housing a liquid explosive and means for detonating said liquid explosive, the improvement comprising:

a collapsible container in fluid communication with the primary charge container, said collapsible charge container supplied with a predetermined volume of liquid explosive such that as said severing system is lowered to the wellhead contraction of the liquid explosive in the primary charge container as a result of pressure and temperature variations will be compensated for by the liquid explosive in said collapsible charge container flowing into the primary charge container thereby ensuring a constant volume of liquid explosive in the primary charge container.

* * * * *